US006817941B1

(12) United States Patent
Gatov

(10) Patent No.: US 6,817,941 B1
(45) Date of Patent: Nov. 16, 2004

(54) UNIFORM AIRFLOW DIFFUSER

(75) Inventor: Michael S. Gatov, Troutdale, OR (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 10/033,090

(22) Filed: Oct. 25, 2001

(51) Int. Cl.[7] ..... B01L 1/04
(52) U.S. Cl. ..... 454/187; 55/385.2
(58) Field of Search ..... 454/187; 55/385.2, 55/484, DIG. 29

(56) References Cited

U.S. PATENT DOCUMENTS 2,291,220 A * 7/1942 Germonprez ..... 454/296
3,363,532 A * 1/1968 Horneff et al. ..... 454/187
3,625,134 A * 12/1971 Smith ..... 454/365
3,726,204 A * 4/1973 Lindestrom ..... 454/189
3,824,909 A * 7/1974 Horneff et al. ..... 454/187
3,975,995 A * 8/1976 Shuler ..... 454/187
4,170,930 A * 10/1979 Lind ..... 454/297
4,554,766 A * 11/1985 Ziemer et al. ..... 454/187
4,747,341 A * 5/1988 Hedrick ..... 454/187
4,963,069 A * 10/1990 Wurst et al. ..... 414/416.01
5,192,348 A * 3/1993 Ludwig ..... 454/187
5,263,290 A * 11/1993 Gardner ..... 52/220.6
5,788,567 A * 8/1998 Chang et al. ..... 454/187
5,803,721 A * 9/1998 Lee ..... 417/423.14
6,080,060 A * 6/2000 Larsson ..... 454/187
6,123,617 A * 9/2000 Johnson ..... 454/187
6,145,335 A * 11/2000 Nagaoka ..... 62/272
6,368,208 B1 * 4/2002 Minoshima ..... 454/187

* cited by examiner

*Primary Examiner*—Derek S. Boles
(74) *Attorney, Agent, or Firm*—Suiter West PC LLO

(57) ABSTRACT

The present invention is directed to a uniform airflow diffuser for utilization in a process chamber, such as a process chamber utilized in the manufacture of semiconductor chips. The uniform airflow diffuser is suitable for generating a back flow of air sufficient to cause the airflow to be distributed across the airflow diffuser. The resultant build-up in pressure in the plenum area may result in uniform airflow through a plurality of holes included in the airflow diffuser yielding substantially laminar airflow through the chamber.

28 Claims, 3 Drawing Sheets

UNIFORM AIRFLOW DIFFUSER

FIELD OF THE INVENTION

The present invention generally relates to the field of air handling and particularly to airflow diffusers.

BACKGROUND OF THE INVENTION

Electronics have become an increasingly, competitive industry as technology becomes more pervasive in society. The inclusion of electronic components in a variety of devices increases the demand for components. With the current demand for electronic devices, production techniques become more important as competitors seek to gain an advantage over their competition. As a result, innovations in the field of electronics production may yield a tremendous advantage in reputation and increased savings due to reduction in the number of rejected products.

Critical to the production of electronic devices is quality control. The number of products failing to meet desired standards can severely impact the production costs. As a result, emphasis is placed on increasing the quality of the electrical components and reducing the number of non-conforming products.

An important area of quality control in electronics manufacturing is the elimination of contamination on wafers during microprocessor chip manufacturing. During chip production substrate wafers may be subject to having particles deposited on the wafer surface. Particle deposition in critical wafer areas may make it unusable. Thus, the elimination of contaminate particles may result in higher quality and thus a reduction in non-conforming microchips.

During microchip production, typically manufacturing is conducted utilizing chambers to control process conditions. Airflow through the chamber may aid in removing particles generated as wafer production is conducted. Process chambers rely on air filters such as an ultra low penetrating air (ULPA) filters to eliminate contaminates from air entering the chamber, and to remove contaminates generated during manufacturing. One difficulty with current air-handling systems is that once the air is passed through the air filter the flow of air is often disrupted downstream of the air filter resulting in uneven airflow and even possible turbulent conditions. Uneven airflow may result in particles being entrained in turbulent air currents, rather then exiting the chamber as desired. Entrained particles may be reintroduced to the air-stream if should an event disturb the airflow. The airflow may be disturbed for example, by robotic mechanisms producing the semiconductors and the like. Entrained particles may contaminate then contaminate the wafer.

Another drawback to current airflow systems is that the air filters often are not designed to fit the entire airflow entrance plane of the chamber. Thus air may be directed from only a portion of a side of the chamber, such as from the center of the top of the chamber. As a result of limited air dispersion, air may not be directed through-out the entire chamber resulting in zones where particles may be trapped.

Additional problems include, the cost and complexity of retrofitting chambers having unacceptable airflow system, with larger and irregularly shaped filters. Furthermore, the lack of suitable airflow system addressing the above mentioned difficulties will result in the continuation of defects in products and low manufacturing efficiency.

Therefore, it would be desirable to provide a airflow diffuser suitable for providing uniform airflow.

SUMMARY OF THE INVENTION

Accordingly, the present invention is directed to an air diffuser for utilization in a process chamber, such as a chamber utilized in manufacturing microprocessor chips. In a first aspect of the present invention, a process chamber airflow system includes an air diffuser suitable for providing uniform airflow through the chamber. Initially, a blower may generate an initial flow of air. The initial flow of air may be directed through an air filter disposed in the connection between the blower and a plenum.

Connected to the plenum and disposed in the airflow may be an air diffuser containing a plurality of holes. The plurality of holes in the air diffuser may reduce the flow of air through the holes when compared to the initial flow of air generated by the blower. The plurality of holes in the air diffuser may contain a cross-sectional area, through which air may flow through, less then that of the initial inlet, unrestricted air entrance plane, cross-sectional area generated by the blower.

The reduction in the cross-sectional area may result in a back flow of air in the plenum and a resultant rise in pressure. The rise in pressure may generate a uniform dispersal in airflow across a side of the air diffuser disposed against the plenum. The rise in pressure may yield a uniform flow of air through the plurality of holes and substantially laminar airflow.

In a second aspect of the present invention, an air diffuser suitable for utilization in a process chamber is disclosed. The air diffuser includes a plate with a first and a second side and a plurality of holes contained within the plate penetrating the first and second sides. The plurality of holes in the plate may be uniformly dispersed and be sufficient to cause the second side of the plate to experience a pressure lower then that of the first side when disposed in an airflow.

In a third aspect of the present invention a method of providing substantially laminar airflow in a process chamber is disclosed. Providing substantially laminar air flow includes generating an initial flow of air with an initial cross-sectional area. Disposing an air diffuser with a plurality of uniformly spaced holes with a total cross-section less than the initial airflow in the flow of air generated by the blower. An increase in a back-pressure of air may be created due to the reduction is cross-sectional area, resulting in an eventual dispersion of a portion of the initial airflow uniformly across the air diffuser. Subsequently, a uniform flow of air may be provided through the plurality of holes included in the air diffuser to the process chamber.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the present invention, examples of which are illustrated in the accompanying drawings.

Referring generally now to FIGS. 1 through 5, exemplary embodiments of the present invention are shown wherein an air diffuser is utilized to provide uniform airflow throughout a chamber, such as a process chamber for manufacturing semiconductor chips. Drawbacks to previous airflow systems have been the lack of uniformity in dispersing air in the chamber, which may lead to the entrainment of particles. Utilization of the present invention, eliminates turbulent airflow and allows for uniform airflow throughout the chamber. Additionally, the present invention has the capability of being easily retrofitted into chambers currently in use to make more efficient use of available resources.

Figure 1:
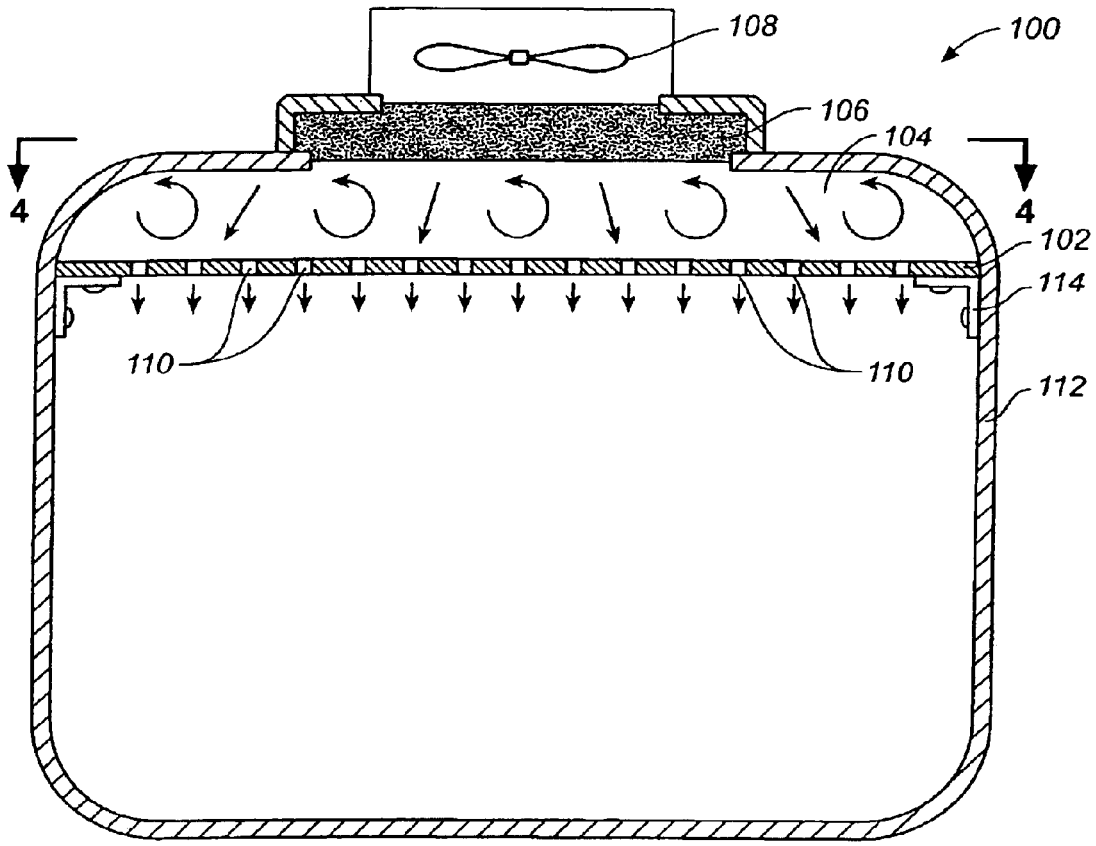
FIG. 1 is an overview illustration of an exemplary embodiment wherein a process chamber airflow system is shown.

Referring now to FIG. 1, an embodiment of the present invention is shown wherein a chamber airflow system 100 includes an air diffuser 102. Initially, a fan or blower 108 may be utilized to generate a flow of air to be introduced to the chamber 112; such as a chamber utilized in the production of electronics, semiconductor chips or the like. Disposed between the blower 108 and a plenum 104, connecting both is an air filter suitable for removing particles from the airflow created by the blower 108. Prior to entering the chamber 112 air may be filtered to remove contaminates. Air may be circulated through the chamber 112 to assist in the manufacturing process, remove waste generated during processing and the like.

Initially airflow may be provided through an air filter 106 such as a ultra low penetrating air (ULPA) filter or the like. Once the air exits the filter 106 the flow may be turbulent due to varying rates of diffusion through the filter 106, air pressure differences caused by the blower and the like.

Air exiting the filter 106 enters the plenum 104. The plenum 104 may be capable of receiving the initial flow of air from the filter 106. Additionally, the plenum 104 may be designed to provide airflow to an entire side of the air diffuser 102. The flow of air is then directed through the plenum 104, to the air diffuser 102 connected to the plenum 104.

The air diffuser 102 may include a plurality of holes 110 through which the flow of air is directed into the chamber 112. In an embodiment, the air diffuser may form a plate with a plurality of holes penetrating through a first side and a second side of the plate. The plurality of holes 110 may be sufficient to reduce the flow of air initially received by the plenum 104. In further embodiments the plurality of holes 110 may range in size from 0.125 inches to 0.5 inches. In additional embodiments, the cross-sectional areas of the individual plurality of holes may vary as contemplated by one of ordinary skill in the art, without departing from the scope and spirit of the present invention. See generally FIG. 5, wherein the plurality of holes include holes having various cross-sectional areas, such as aperture 210A.

A reduction in the airflow through the plurality of holes 110 included in the air diffuser 102 as compared to the initial airflow through the air filter 106 may create an increase in air pressure in the plenum 104 due to not all the air being transmitted through the diffuser 102. As a result of the back flow, pressure may increase in the plenum 104 resulting in uniform airflow through the holes included in the diffuser 102.

The air diffuser 102 may be constructed from at least one of a metal and a plastic. In a further embodiment, the air diffuser 102 is constructed of stainless steel. Furthermore, the air diffuser 102 may be capable of dissipating static charges, such as in the case of a charged particle coming in contact with the diffuser 102.

The air diffuser 102 may contain a device to secure the air diffuser to the chamber 112. Securing devices 114 may include a screw, bracket, key lock, latch, spring loaded pins and the like. The air diffuser 102 may be secured to the chamber 112 to inhibit airflow around the air diffuser 102 and keep the air diffuser 102 from interfering with processing occurring in the chamber 112.

Figure 2:
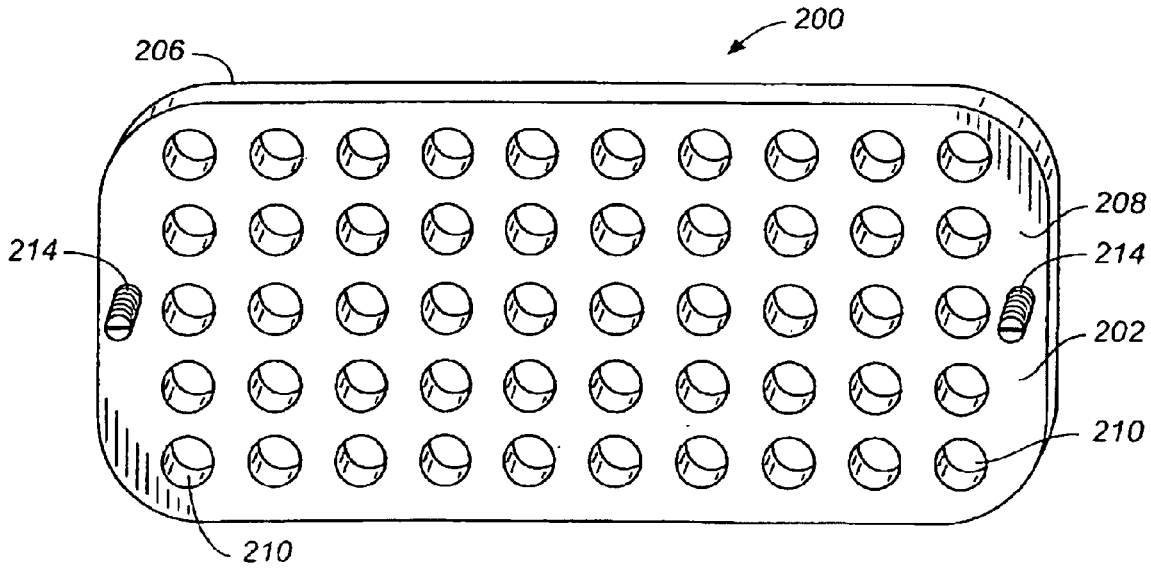
FIG. 2 is an overview illustration of an exemplary embodiment wherein a process chamber air diffuser contains a plurality of holes an a screw type means for securing the diffuser.

Referring now to FIG. 2 an airflow diffuser 200, suitable for utilization in a processing chamber is shown. In a present embodiment, the airflow diffuser 202 includes a plate 204 with a first side 206 and a second side 208. The plate 202 contains a plurality of holes 210 which penetrate the first and the second sides 206 & 208 to allow air to pass through.

The plurality of holes penetrating the plate 202 may be sufficient to cause the first side 206 of the plate to experience a first pressure and the second side 208 to experience a pressure lower then that of the first pressure when the diffuser 200 is disposed in an airflow. The variation in pressure experienced between the first and the second sides 206 & 208 may be obtained by including a plurality of holes 210 with a total cross-sectional area lower then that of an inlet, such as that of the air filter disposed between the blower 108 and the plenum 104 of FIG. 1, thus uniform airflow through the plurality of holes 2210 may be achieved by dispersing the airflow across the first side 206 of the plate 204. It is to be understood that the cross-sectional area, and placement of an individual hole included in the plurality of holes may vary as contemplated by one of ordinary skill in the art without departing from the scope and spirit of the present invention.

In an exemplary embodiment, the plurality of holes 210 are uniformly dispersed throughout the plate 202 to provide substantially laminar airflow through a process chamber, such as the chamber 112 of FIG. 1. Furthermore, in additional embodiments the plurality of holes may range in size from 0.125 inches to 0.5 inches. Additionally, the plate 202 may be designed to fit a specified process chamber so that air passing through the air diffuser 200 does not cause turbulence that may entrain particles.

In another embodiment the air diffuser 200 further includes a means for securing the plate 204, to a plenum such as the plenum 104 of FIG. 1. The securing means 214 may be a screw, a bracket, a key lock, a latch, spring loaded pins and the like.

Figure 3:
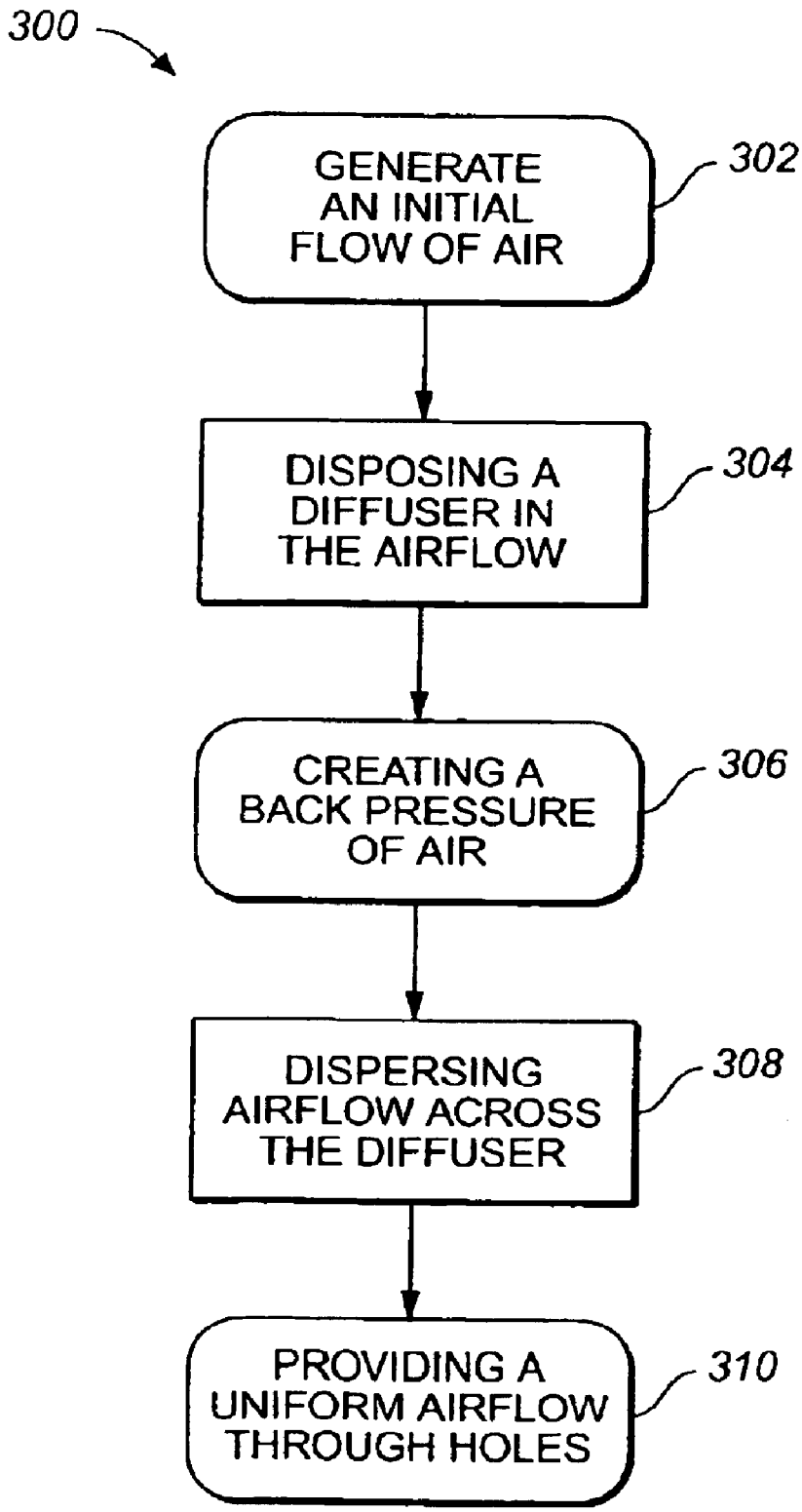
FIG. 3 is a flow diagram of a method for employing the air diffuser of the present invention to provide substantially laminar air flow through a process chamber.
Figure 4:
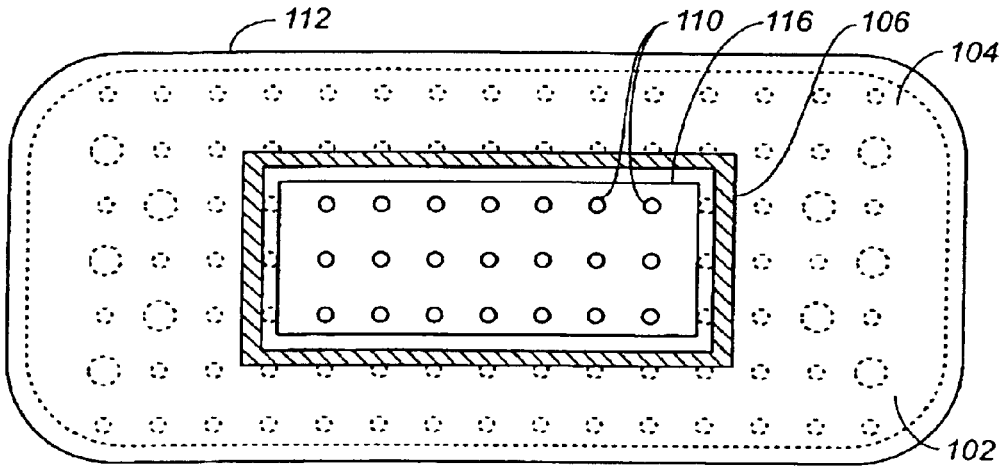
FIG. 4 is a view of a cross-sectional area of a received initial flow of air into a plenum.
Figure 5:
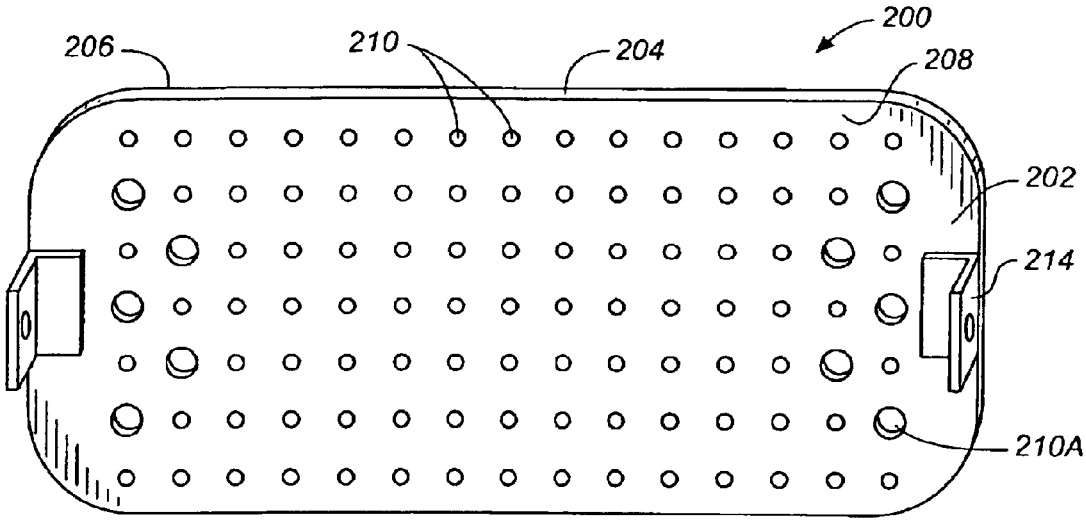
FIG. 5 is and overview illustration of a process chamber air diffuser containing a plurality of holes including holes having varying cross-sectional areas.

In reference to FIG. 3, a method for providing substantially laminar airflow through a process chamber 300 is shown. Providing laminar airflow through a process chamber may reduce contamination, non-conforming products and reduce production costs. Initially, a flow of air may be generated by fan or blower. Generating an airflow 302 may include filtering the initial flow of air for contaminates.

Once the airflow has been generated it may have an initial cross-sectional area as air is flowed into a plenum. Connected to the plenum, disposed in the airflow is an air diffuser with a plurality of uniformly spaced holes. Disposing the air diffuser 304 in the airflow may include utilizing a means for securing the air diffuser to the plenum to prevent accidental damage to process chamber contents and ensure the flow of air through the plurality of holes. The plurality of holes in the air diffuser may have a total cross-sectional area less then that of the initial cross-sectional area. See generally FIG. 4, wherein an initial flow of air passes through the plenum inlet. The cross-sectional area of the inlet 116 is less than the total cross-sectional area of the plurality of holes penetrating the diffuser 102.

As the airflow is directed through the plenum to the air diffuser, a back-pressure of air is created due to the reduction in the cross-sectional area of the plurality of holes in comparison to the initial cross-sectional area. Creating a back-pressure of air 306 may be achieved by the initial airflow being greater then may be passed through the plurality of holes in the air diffuser.

As a portion of the airflow becomes trapped in the plenum, the airflow may disperse across the air diffuser due to an increase in pressure, as a result of the back flow of air. Dispersing a portion of the initial airflow 308 may result in the flow of air being equalized through the plurality of holes.

After the initial airflow is dispersed across the air diffuser 308, a uniform flow of air may provided through the plurality of holes. Providing uniform airflow 310 through the plurality of holes included in the air diffuser may allow for substantially laminar airflow throughout the process chamber.

It is believed that the UNIFORM AIRFLOW DIFFUSER of the present invention and many of its attendant advantages will be understood by the forgoing description. It is also believed that it will be apparent that various changes may be made in the form, construction and arrangement of the components/steps thereof without departing from the scope and spirit of the invention or without sacrificing all of its material advantages. The form herein before described being merely an explanatory embodiment thereof. It is the intention of the following claims to encompass and include such changes.

What is claimed is:

1. A process chamber airflow system, comprising:

a blower suitable for creating an initial flow of air suitable for circulation in a process chamber;

a plenum capable of receiving the initial flow of air; wherein the plenum is connected to the blower and the process chamber; and an air diffuser, connected to the plenum, wherein the air diffuser contains a plurality of holes, such that the initial flow of air through the plenum is reduced.

2. The process chamber airflow system of claim 1, wherein the air diffuser further comprises:

a means for securing the air diffuser to the plenum.

3. The process chamber airflow system of claim 1, wherein the reduction in airflow is sufficient to cause the initial airflow to be distributed uniformly through the plurality of holes in the air diffuser.

4. The process chamber airflow system as claimed in claim 3, wherein the air diffuser eliminates initial airflow turbulence entering the plenum from an air filter.

5. The process chamber airflow system of claim 1, further comprising a filter disposed between the blower and the plenum.

6. The process chamber airflow system as claimed in claim 5, wherein individual holes, included in the plurality of holes, have varying cross-sectional areas.

7. The process chamber airflow system of claim 1, wherein the air diffuser is formed of static charge dissipating material.

8. The process chamber airflow system of claim 1, wherein the air diffuser's plurality of holes are uniformly distributed throughout the air diffuser.

9. The process chamber airflow system of claim 1, wherein the air diffuser is disposed on one side of a generally cubic chamber of a semiconductor production device.

10. The process chamber airflow system of claim 1, wherein the chamber is suitable for utilization in microchip production.

11. The process chamber airflow system of claim 1, wherein the plurality of holes range in size from 0.125 inches to 0.5 inches.

12. An air diffuser for utilization in a process chamber, comprising a means for securing the air diffuser to the process chamber; and a plate with a first side and a second side, connected to the securing means, wherein the plate includes a plurality of holes penetrating the first and the second sides; wherein the plurality of holes are uniformly dispersed throughout the plate; wherein the plurality of holes are sufficient to cause the first side of plate to experience a first pressure and the second side to experience a pressure lower then the first pressure when the plate is disposed in an airflow.

13. The air diffuser of claim 12, wherein the plurality of holes has a total cross-sectional area lower then that of an inlet supplying the airflow.

14. The air diffuser of claim 12, wherein the change in pressure between the first and the second sides of the plate is sufficient to distribute the airflow through the entire plurality of holes.

15. The process chamber airflow system as claimed in claim 12, wherein individual holes, included in the plurality of holes, have varying cross-sectional areas.

16. The air diffuser of claim 12, wherein the plate is formed of static charge dissipating material.

17. The air diffuser of claim 12, wherein the air diffuser diffuses air with a substantially laminar flow.

18. The air diffuser of claim 12, wherein the plurality of holes range in size from 0.125 inches to 0.5 inches.

19. A method of providing substantially laminar airflow in a process chamber, comprising:

generating an initial flow of air with an initial cross-sectional area;

disposing an air diffuser with a plurality of uniformly spaced hole in the airflow, wherein a total cross-sectional area of the plurality of holes is less then the initial cross-sectional area;

creating a back-pressure of air due to the reduction in the cross-sectional area through the plurality of holes;

dispersing a portion of the initial airflow uniformly across the air diffuser; and providing uniform airflow through the plurality of holes included in the air diffuser, to the process chamber.

20. A process chamber airflow system, comprising:

a blower suitable for creating an initial flow of air suitable for circulation in a process chamber;

a plenum capable of receiving the initial flow of air; wherein the plenum is connected to the blower and the process chamber; and an air diffuser including a plurality of holes therein connected to the plenum, the cross-sectional area of the air diffuser is greater than the cross-sectional area of the received initial flow of air into the plenum;

wherein the initial air flow into the plenum is greater than the flow of air through the plurality of holes in the air diffuser.

21. The process chamber airflow system of claim 20, wherein the reduction in airflow is sufficient to cause the initial airflow to be distributed uniformly through the plurality of holes in the air diffuser.

22. The process chamber airflow system of claim 20, wherein the air diffuser is formed of static charge dissipating material.

23. The process chamber airflow system of claim 20, wherein the air diffuser diffuses air, such that contaminate particles are removed from the chamber by the chamber airflow.

24. A semiconductor production device, comprising:

a generally cubic process chamber for producing semiconductors; and an airflow system mounted generally on a side of the process chamber, said airflow system including:

a blower suitable for creating an initial flow of air suitable for circulation in the process chamber;

a plenum capable of receiving the initial flow of air; wherein the plenum is connected to the blower and the process chamber; and an air diffuser, connected to the plenum, wherein the air diffuser contains a plurality of holes, such that the initial flow of air through the plenum is reduced, wherein the initial air flow into the plenum is greater than the flow of air through the plurality of holes in the air diffuser.

25. The semiconductor production device of claim 24, wherein the reduction in airflow is sufficient to cause the initial airflow to be distributed uniformly through the plurality of holes in the air diffuser.

26. The semiconductor production device of claim 25, wherein the air diffuser eliminates initial airflow turbulence entering the plenum from an air filter.

27. The semiconductor production device of claim 24, further comprising a filter disposed between the blower and the plenum.

28. The semiconductor production device of claim 24, wherein the air diffuser is formed of static charge dissipating material.

* * * * *